United States Patent [19]

Bogenschneider et al.

[11] 4,257,879

[45] Mar. 24, 1981

[54] PROCESS FOR DEWATERING COAL SLURRIES

[75] Inventors: Bernd Bogenschneider, Essen; Rolf Köhling, Bochum; Heinz Kubitza, Essen; Wilhelm Blankmeister, Essen; Dieter Leininger, Essen, all of Fed. Rep. of Germany

[73] Assignee: Bergwerksverband GmbH, Essen, Fed. Rep. of Germany

[21] Appl. No.: 76,504

[22] Filed: Sep. 17, 1979

Related U.S. Application Data

[63] Continuation-in-part of Ser. No. 9,698, Feb. 5, 1979, abandoned, which is a continuation of Ser. No. 843,781, Oct. 19, 1977, abandoned.

[30] Foreign Application Priority Data

Oct. 21, 1977 [DE] Fed. Rep. of Germany ..... 2647554

[51] Int. Cl.[3] ..... B03B 9/00

[52] U.S. Cl. ..... 209/5; 209/1; 209/12; 209/17; 209/233

[58] Field of Search ..... 209/1, 5, 10, 17, 208, 209/211, 2, 12, 13, 18, 233, 268; 210/44, 73 R, 75, 84, 74, 86

[56] References Cited

U.S. PATENT DOCUMENTS

| | | | |
|---|---|---|---|
| 3,045,818 | 7/1962 | Muschenborn et al. | 209/5 X |
| 3,200,068 | 8/1965 | Jonakin et al. | 210/73 R X |
| 3,398,093 | 8/1968 | Ferney | 210/74 X |
| 3,579,442 | 5/1971 | Gerwig | 210/44 |
| 3,696,923 | 10/1972 | Miller | 210/44 X |
| 3,856,668 | 12/1974 | Shubert | 209/5 X |
| 3,890,229 | 6/1975 | Eder | 210/73 |
| 3,928,182 | 12/1975 | Eder | 209/18 X |
| 4,126,426 | 11/1978 | Verschuur | 210/74 X |

*Primary Examiner*—Ralph J. Hill
*Attorney, Agent, or Firm*—Michael J. Striker

[57] ABSTRACT

The invention concerns a method for optimization of the coal slurry dewatering process. Through a regulation of the fine grain content, it is possible to keep the filter cake at a constant level and thus to maximize the dewatering process. A separation of the slurry into a predominantly relatively fine grain fraction and a relatively coarse grain fraction, with the division point being between about 0.03 and 0.15 mm, is carried out, with a formation of a coal agglomerate from the fine grain fraction, and a dehydration of both the coarse grain fraction and the coal agglomerate from the fine grain fraction.

10 Claims, 2 Drawing Figures

PROCESS FOR DEWATERING COAL SLURRIES

This application is a continuation-in-part of my copending U.S. application Ser. No. 9,698, Feb. 5, 1979, now abandoned, which in turn was a continuation of U.S. application Ser. No. 843,781, Oct. 19, 1977, now abandoned.

The invention concerns a process for dewatering of coal slurries which constitutes an improvement over the known processes for deashing and dewatering of coal slurries. The known processes involve the mixing of the coal slurry with 3–10% of oil in a conditioning mixer. The coal slurry which has been mixed with oil is then passed over a screen and through a centrifuge with a perforated basket with 0.2–0.5 mm apertures. Through this step the coal-oil mixture is discharged as a low ash, dewatered concentrate, while dirt particles pass through the screen and the basket of the centrifuge as effluent.

Experiments with various processes for deashing and dewatering of coal slurries with coal grains up to about 1 mm have shown that a very high component of the finest grain size (up to about 0.06 mm) in these slurries, on the one hand, is a hindrance in the dewatering through filtration or in a flotation process with a subsequent filtration, while on the other hand a certain fine-grain component (grains up to about 0.06 mm) in these coal slurries is useful for dewatering or a flotation with subsequent dewatering.

The instant invention is predicated upon the determination that it is possible, through a constant regulation of the fine grain content (hereinafter used to refer to grain sizes below 0.06 mm) in coal slurries with grains predominantly over 0.06 mm in diameter (hereinafter, coarse grain slurries), to keep the size of the filter cake derived from these slurries constant. The technical importance of delivering to the filter sufficient solids to provide a filter cake which does not fall below e.g. 10 mm in thickness is considerable, as filter cakes which fall below a mixed thickness lead to uneconomic dewatering. The effectiveness of the filter (in t/h filter cake) is too low, the operation of the filter becomes more difficult, the costs of slurry dewatering become too high and the water content of the filter cake remains too high on account of the formation of cracks or channels in the filter cake, through which drying air passes instead of through the body of the filtration residue. It is therefore necessary that the filter cake be maintained at a thickness above about 10 mm.

Through reduction of the finest component in the coal slurry to be dewatered, a filter cake which would otherwise be too thin and insufficiently dewatered can be brought to the required thickness, up to a maximum of about 20 mm. Moreover, this result can be achieved in a simpler and more economic manner than through regulation of the filtration parameters, such as the rotational speed of the filter or the magnitude of the vacuum.

This goal is achieved through the inventive process by separating the slurry which is to be dewatered, which slurry is generated in the treatment of raw coal, into a slurry fraction containing predominantly relatively fine grains and a slurry fraction containing predominantly relatively coarse grains. The dividing line between these two fractions is between about 0.03 and 0.15 mm grain size. The coarse grain fraction as prepared generally contains between about 15 and 30% fine grain size material; the grain size spectrum of this coarse grain slurry fraction is well adapted to a dehydration or a flotation with subsequent dehydration.

The fine grain fraction (hereinafter, fraction C) is then subjected to a phase inversion treatment by contacting the slurry solids with a hydrophobic agent, whereby a mixture of agglomerated coal and of water containing most of the ash of the fine grain slurry fraction is formed. This resultant mixture, hereinafter fraction D, is then dehydrated. The coarse grain fraction (fraction B) is also subjected to a dehydration, to form a concentrate $F_1$ or else a flotation and subsequent dehydration, to form a concentrate $F_2$.

In that the separation cross section leads to a separation grain size between 0.03 and 0.15 mm, one obtains a coarse grain fraction, which is well suited to filtration or to flotation with subsequent filtration, and on the other hand a slurry fraction in which the grain size is predominantly under 0.06 mm, the so-called fine grain fraction. This fine grain fraction is kept so low, through the separation cross section which has been found to be advantageous, that the use of the above-noted process, an otherwise very expensive deashing and dewatering by means of oil, becomes economically suitable, with reference to the total slurry. The invention simultaneously provides that the finest grain fraction, i.e., that with grain size up to about 0.06 mm, comprises about 15–30% of the coarse-grain slurry fraction, so that the thickness of the filter cake in the filtration of the slurry does not generally exceed about 20 mm, which in any case would be disadvantageous.

The dewatering of the coal slurries then follows, preferably through vacuum filtration, which may be carried out in a trommel through which the slurry is passed. The effectiveness of the filtration may be improved through the use of steam treatments of the filter cake.

The separation of the original slurry into the above-noted fractions can be effortlessly effected through the use of e.g. a hydrocyclone. A regulation of the separation cross section in dependence upon the thickness of the filter cake is possible during the filtration through regulation of the pressure of delivery to the cyclone.

In the case where instead of a hydrocyclone, a stream classifier or clarifier is used for the above-noted separation of the slurry, the component of the fine grain fraction in the coarse fraction may perforce turn out to be too small. In this case, according to a modification of the process, a portion (for example, 10–30 weight-%) of the fine grain slurry can be introduced into the coarse grain fraction, before this is filtered or treated by flotation and filtration. This addition of the fine-grain fraction can also be automatically regulated with reference to the thickness of the filter cake.

In treatments of the fine grain slurry fraction with oil in a mixer, the mineral components or particles are predominantly in the form of a dispersion, while the coal particles form agglomerates. This mixture contains in general about 50–75% water. The agglomerated coal can be separated from the mixture with the aid of a screen; after this preliminary dewatering, the coal from the fine grain slurry fraction can be treated separately in a second treatment step, such as through the use of a centrifuge, whereby it is further dewatered. The agglomerate which is removed from the mixture has a water content between about 25–45%; after the second dewatering treatment, the water content is reduced to about 7%. Alternatively, the coal after preliminary dewatering can be mixed with other fractions from the coal work-up. Excess oil is thus proferred to the coal particles of other fractions, whereby the ultimate goal of a dewatering of a variety of coal fractions is more effectively achieved.

A similar advantageous effect can also be achieved in the case where the mixture with about 50–75% water, i.e., without preliminary dewatering, is mixed with other fractions of the coal preparation and then dewatered.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
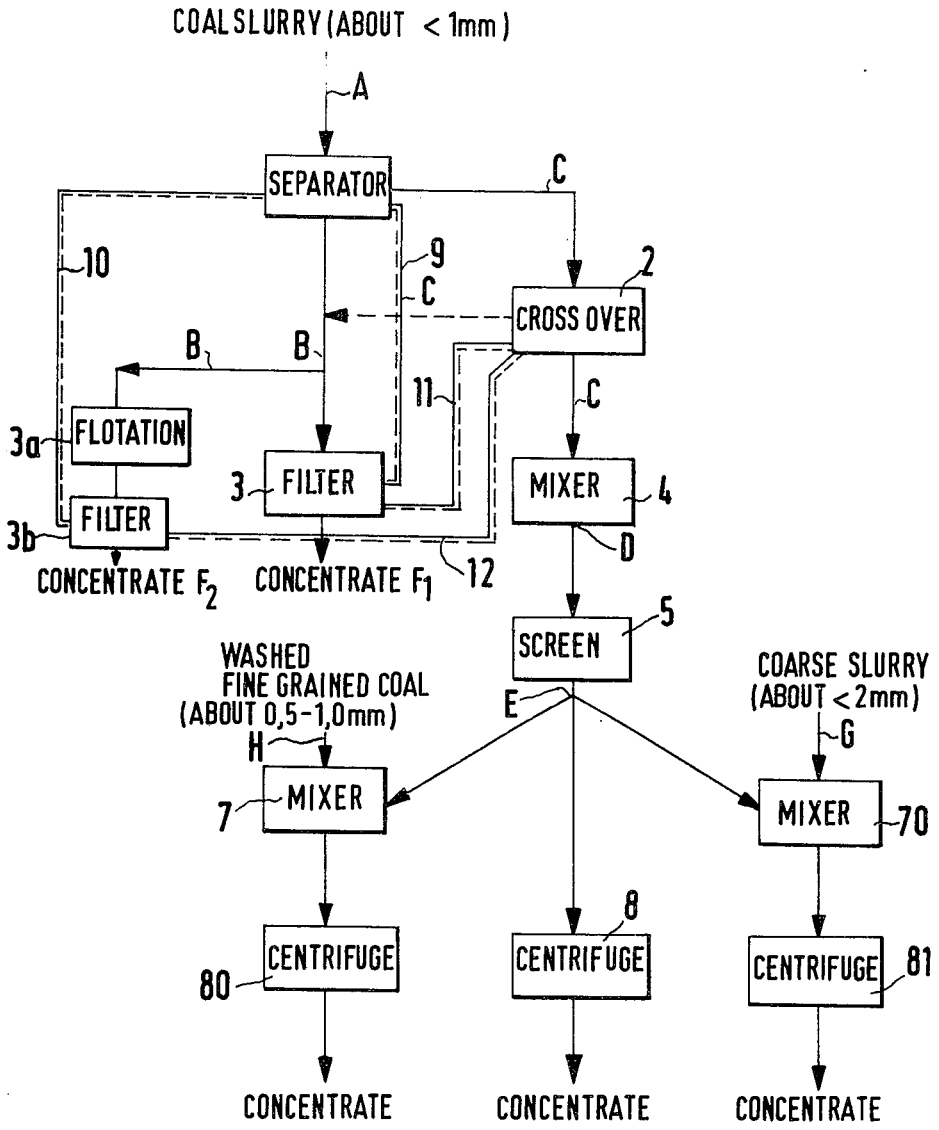
FIG. 1 illustrates in the form of a flow diagram the embodiment of the inventive process wherein coal agglomerates from the fine grain fraction are mixed with other coal fractions.

With reference to the Figure, coal slurry A with grains up to about 1 mm in diameter is introduced into a hydrocyclone 1 and separated into a slurry fraction C which is high in fine grain content and a slurry fraction B which is low in fine grain content. The separation cross section lies between about 0.03 and 0.15 mm, and preferably between 0.04 and 0.10 mm.

The slurry fraction B is dewatered in stage 3 or treated to a flotation in stage 3*a* and a subsequent filtration in stage 3*b*. The dewatering follows by means of a vacuum filter, in which the thickness of the filter cake is held constant through the regulator conduits or connections 9 or 10.

The fine grain fraction C is intimately mixed in a pressure mixer 4, such as for example a high speed stirrer or stator-rotor mixer, with water-insoluble liquid hydrocarbons, such as diesel oil, in an amount of between about 3 and 10 weight-%, calculated from the weight of the solid coal material. The suspension D which is formed thereby, consisting of coal agglomerates, dispersed mineral particles and water, is then separated from the water by means of a screening device 5. The resultant material mixture E consists essentially of the coal agglomerates and still contains about 25–45% water. These agglomerates can be mixed with other coal fractions, as indicated by the broken arrows from E to stages 7 and 70, which mixtures can then be dewatered together in a centrifuge.

Figure 2:
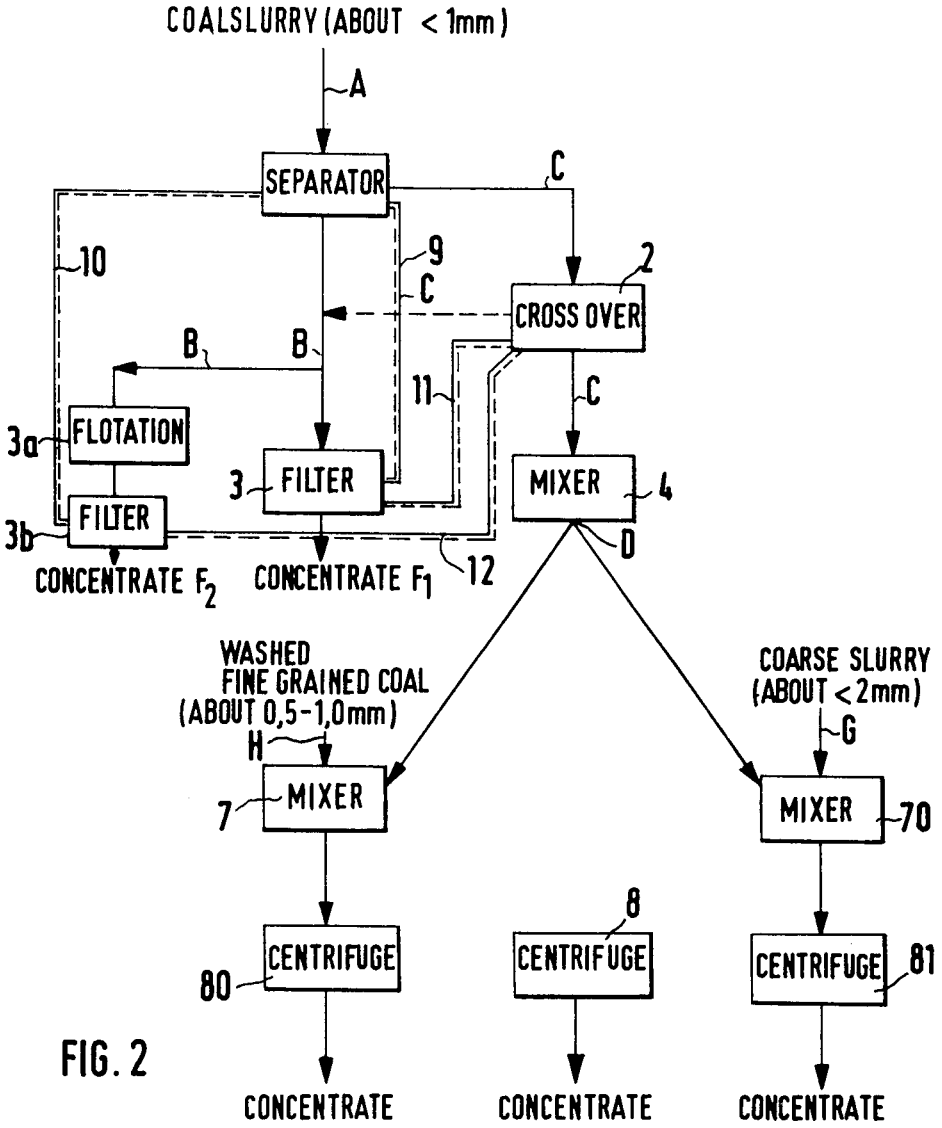
In FIG. 2 the fine grain fraction is not preliminarily dewatered before mixing with other coal fractions.

In FIG. 2 it is seen that in place of the agglomerates E, the mixture D which has not been treated to a preliminary dewatering can be mixed with other coal fractions and dewatered, as the arrows from D to stages 7 and 70 illustrate.

In the case where the separator cross section A leads to a treatment in two clarifying devices (such as, for example, concentrators), the fraction B is removed from the base of the first concentrator and, as necessary, is combined with a portion of slurry fraction D, which is removed from the base of the second subsequent concentrator. The slurry is then treated to filtration, or in case of unsatisfactory ash content, to a flotation with a subsequent filtration. The requirement of fraction B in fraction C is determined through a measurement of the thickness of the filter cake in filter 3 or 3*b*, and the necessary amount added via regulating conduits 11 or 12 from the cross-over stage 2.

The residual portion of fraction C (in general about 70–90% of the original amount) is then treated further as noted above.

The invention provides a process which leads to a reliable reduction in the ash content and dewatering of coal slurries with a low input requirement in expensive oil and a well-functioning purification and substantial dewatering of coal slurries with grain sizes up to about 1 mm.

The invention may be further understood through the following examples.

EXAMPLE 1

In a work-up apparatus for mineral coal with a throughput of about 1000 t/h, there results through the use of a settling machine washer (jig-washery) about 3000 $m^3$/h wash water with a solids content of about 37 t/h, i.e., about 111 g/l coal solids with a grain size of less than 2 mm, which solids are predominantly in the form of a slurry. The component of fine coal grains with a size less than about 0.06 mm is about 36%.

A coarse slurry G, containing particles with a grain size between about 1 mm and 2 mm, is separated from the total slurry by means of a screening machine. The very coarse slurry constitutes about 11 t/h.

The coal slurry A, which is freed of the coarsest grains (2986 $m^3$/h with 100 t/h solids with at most a size of 1 mm), is then separated in hydrocyclone 1 into a fine grain fraction C (grain size predominantly under 0.06 mm) and a fraction B poor in fine grains (grain size predominantly over 0.06 mm).

The coal slurry B has a fine grain content of about 24% and is dewatered by means of a vacuum filter trommel 3, which is operated under a steaming cone or dome. The thickness of the filter cake is adjusted at about 14 mm. The dewatered filter cake, i.e., concentrate $F_1$, has a water content of about 14%.

The constant maintenance of the filter cake thickness is achieved through regulation, in which the thickness of the filter cake is measured by means of a radiation measuring apparatus, which allows for constant determinations without any disturbance of the filter cake. The measurement value in turn is used to control by means of a pump the influx pressure of slurry A on the hydrocyclone.

The influx pressure of the slurry on the cyclone is automatically reduced as the size of the filter cake increases. In this manner, the separation cross section in the cyclone is shifted and reversed in the direction of a finer separation grain fraction, i.e., to lead to a higher component of fine grains in fraction B.

The fine grain slurry C is intimately mixed with 8 weight-% light fuel oil, calculated from the solids content of the slurry, in a fast-running mixer 4. In this manner, the coal particles are agglomerated. The resulting mixture D is dewatered by means of a vibration screen and thereby the agglomerate is separated from water and the mineral particles suspended therein. The water content of the agglomerate E is about 35%; the ash content is approximately 12%. In a centrifuge 8 the agglomerate is dewatered to form a concentrate with about 13% water. The ash content of this concentrate is about 9%.

EXAMPLE 2

The coal slurry A as described in Example 1 (2986 $m^3/h$ with 100 t/h solids of at most 1 mm) is introduced into a round concentrator. From the base a coal slurry B (70 t/h solids, 1.0 mm grain size) is removed with a content in fine grains under 0.06 mm of about 13%.

The slurry C which flows out of the concentrator, with 91% fine grains under 0.06 mm is then introduced into a second round concentrator and from this at the base a fine grain coal slurry C is removed (100 $m^3/h$ with 300 g/l solids content, i.e., 30 t/h solids).

The slurry B after mixing with 5.5 t/h of slurry C is sorted or cleaned in a flotation apparatus 3*a* and the flotation concentrate dewatered in a suction filter 3*b* to form a concentrate $F_2$ with a water content of 14%.

The filter cake formed in the suction filter is held constant at a thickness of about 16 mm; this is effected by a steady measurement of the thickness through a radiation measurement means without disturbance of the filter cake. This measurement means is combined with a controllable adjustment hatch 2 via conduit 12, which is mounted in a combining conduit between the delivery conduits of the first and second concentrators. This adjustment hatch opens and closes the conduit through which slurry C flows into the slurry B before the entry of the latter into the flotation apparatus. In case the thickness of the filter cake is reduced, an adjustment is made via the measurement devices so that a smaller amount of slurry C is added to slurry B.

The residual slurry C, as in Example 1, is intimately mixed with 8 weight-%, calculated from the solids, light fuel oil and dewatered in a vibration screen 5 and finally in a screen centrifuge 8. The water content of the agglomerate lies at about 12%, and the ash content at 8.5%.

EXAMPLE 3

The coal agglomerate E obtained according to Example 1 and which has been treated to a preliminary dewatering (water content 35%) is intimately mixed with a coarse grain fraction G which has been given a preliminary dewatering in a swing or shaking screen (grains to 2 mm, water content 30%) and with dewatered fine wash coal H (water content 7 weight-%). This mixture is then dehydrated in a centrifuge.

The mixture contains approximately

| | | |
|---|---|---|
| (E) | Coal agglomerates | 19% |
| (G) | Coarse grain slurry | 11% |
| (H) | Fine wash coal | 70% |

The centrifuge cake has a water content of under 10%.

In contrast, a separate centrifugation of the various fractions yields the following:

| | |
|---|---|
| Dewatering of mixture E separately: | 12% water |
| Dewatering of fraction G separately: | 14% water |
| Dewatering of fraction H separately: | 7% water |
| Average value with separate dewatering | 11.6% Water |

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process for dewatering of coal slurries comprising separating a crude slurry into a slurry fraction containing predominantly relatively fine grain size particles and a slurry fraction containing predominantly relatively coarse grain size particles, said separating being effected at a size between about 0.03 and 0.15 mm grain size; adjusting said coarse grain fraction to contain about 15–30% of said fine grain sized material; subjecting the fine grain slurry fraction to a phase inversion treatment by contacting said particles with a hydrophobic agent, whereby a mixture of agglomerated coal and of water containing a major portion of ash present in said fine grain slurry fraction is formed; dehydrating said agglomerated coal; and subjecting said coarse grain size slurry to a dehydration.

2. A process as defined in claim 1, wherein a portion between about 10 and 30 weight-% of said fine grain size slurry is branched off and passed into said coarse grain size slurry fraction prior to dehydration of said coarse grain size slurry fraction to adjust said coarse grain fraction.

3. A process as defined in claim 2, wherein said branching of said fine grain slurry for addition to said coarse grain slurry is regulated with reference to the thickness of a filter cake generated in the dehydration of said coarse grain slurry.

4. A process as defined in claim 2, wherein said branching of said fine grain slurry for addition to said coarse grain slurry is regulated with reference to the thickness of a filter cake generated in the dehydration of a flotation from said coarse grain slurry.

5. A process as defined in claim 1, wherein said separating according to grain size is regulated with reference to the thickness of a filter cake generated in the dehydration of said coarse grain slurry.

6. A process as defined in claim 1, wherein said separating according to grain size is regulated with reference to the thickness of a filter cake generated in the dehydration of a flotation from said coarse grain slurry.

7. A process as defined in claim 1, wherein said mixture of agglomerated coal and water containing between about 50 and 75% water is dehydrated on a screen whereby said agglomerated coal is separated from ash and a portion of the water to provide a concentrate containing about 25–45% water.

8. A process as defined in claim 1, wherein said mixture of agglomerated coal and water is mixed with a component selected from the group consisting of coarse coal slurry with a grain size less than about 2 mm and a water content of 50–75%, washed fine grain coal between 0.5–10 mm and 25–35% water content, and mixtures thereof, and concentrated on a centrifuge.

9. A process as defined in claim 1, wherein said mixture of agglomerated coal and water is dehydrated on a screen to a water content of 25–45% and then mixed with a component selected from the group consisting of coarse coal slurry with a grain size under 2 mm and water content of 50–75%, washed fine grain coal between 0.5–10 mm and 25–35% water content, and mixtures thereof, and concentrated on a centrifuge.

10. A process as defined in claim 1, further comprising, after said step of dehydrating said agglomerated coal, the step of subjecting said coarse grain size slurry to a flotation prior to the step of subjecting said coarse grain size slurry to a dehydration.

* * * * *